US006823551B2

(12) United States Patent
Keidel et al.

(10) Patent No.: US 6,823,551 B2
(45) Date of Patent: Nov. 30, 2004

(54) METHOD FOR MANUFACTURING A WATERPROOF SHOE STRUCTURE AND SHOE STRUCTURE PRODUCED BY SAID METHOD

(75) Inventors: Karsten F. Keidel, Wuppertal (DE); Liviu-Mihai Pavelescu, Wuppertal (DE); Paul E. Raith, Wuppertal (DE)

(73) Assignee: Sympatex Technologies GmbH, Wuppertal (DE)

( * ) Notice: Subject to any disclaimer, the term of this patent is extended or adjusted under 35 U.S.C. 154(b) by 27 days.

(21) Appl. No.: 10/373,807

(22) Filed: Feb. 27, 2003

(65) Prior Publication Data

US 2003/0163880 A1 Sep. 4, 2003

(30) Foreign Application Priority Data

Mar. 1, 2002 (EP) ..... 02004707

(51) Int. Cl.[7] ..... A43D 11/00; A43B 13/28

(52) U.S. Cl. ..... 12/142 F; 12/142 C; 12/142 T; 36/12

(58) Field of Search ..... 12/142 F, 142 RS, 12/142 C, 142 T; 36/12, 14, 21, 18, 55

(56) References Cited

U.S. PATENT DOCUMENTS

| | | | | | |
|---|---|---|---|---|---|
| 5,285,546 | A | * | 2/1994 | Haimerl | 12/142 E |
| 5,689,903 | A | * | 11/1997 | Aumann | 36/77 R |
| 5,711,093 | A | * | 1/1998 | Aumann | 36/77 R |
| 5,737,857 | A | * | 4/1998 | Aumann | 36/77 R |
| 5,918,382 | A | * | 7/1999 | Haderlein et al. | 36/14 |
| 5,930,917 | A | * | 8/1999 | Pavelescu et al. | 36/12 |
| 5,943,791 | A | * | 8/1999 | Pavelescu et al. | 36/14 |
| 6,088,935 | A | * | 7/2000 | Pavelescu et al. | 36/14 |
| 2002/0078593 | A1 | * | 6/2002 | Pavelescu et al. | 36/12 |

FOREIGN PATENT DOCUMENTS

| | | |
|---|---|---|
| DE | 44 19 802 A1 | 6/1994 |
| WO | WO 01 12002 A | 2/2001 |

* cited by examiner

*Primary Examiner*—M. D. Patterson
(74) *Attorney, Agent, or Firm*—Oliff & Berridge, PLC

(57) ABSTRACT

A method for manufacturing a shoe structure including an exterior upper sewn at a lower end of the exterior upper lower end to an insole and an interior upper including a waterproof, water-vapour permeable functional layer and a lining, the interior upper having in the region of the sole, an inwardly folded end portion which is connected in a waterproof manner to the insole and has a perimetral edge enclosing an opening.

8 Claims, 4 Drawing Sheets

METHOD FOR MANUFACTURING A WATERPROOF SHOE STRUCTURE AND SHOE STRUCTURE PRODUCED BY SAID METHOD

BACKGROUND OF THE INVENTION

1. Field of Invention

The invention relates to a method for manufacturing a shoe structure.

2. Description of Related Art

A manufacturing method for a shoe structure is described in DE 44 19 802 A1. In the manufacturing method described therein, the seam, connecting the exterior upper with the insole (described therein as the intermediate layer), can only be sewn with great difficulty because, on account of the gluing of the end portion of the interior upper to the intermediate layer, the lower portion of the interior upper lies closely against the exterior upper. This, while sewing the exterior upper to the intermediate layer, the interior upper and the water-vapour permeable, waterproof functional layer are often damaged by the needle. As a result, a shoe produced by this method is no longer waterproof.

SUMMARY OF THE INVENTION

The invention thus provides a method of manufacturing a shoe structure of the type initially described, which effectively avoids damage to the functional layer of the interior upper during the sewing of the exterior upper to the insole. The invention also provides a shoe structure of the type initially described which can be produced at a low price and in which the risk of the functional layer being damaged as a result of the manufacturing method is significantly reduced.

In view of the foregoing, the invention according to one exemplary aspect is a method for manufacturing a shoe structure including an exterior upper sewn at a lower end of the exterior upper to an insole, and an interior upper including a waterproof, water-vapour permeable functional layer and a lining, the interior upper having in the region of the insole, an inwardly folded end portion which is connected in a waterproof manner to the insole and has a perimetral edge enclosing an opening, the method including the steps of providing the exterior upper whose lower end is contoured towards the insole so as to correspond at least approximately to an outer contour of the insole; providing the interior upper having at least a lining facing the inside of the shoe structure and a functional layer, the interior upper having towards the insole, the inwardly folded end portion that has the perimetral edge enclosing the opening; providing the insole with a layer of an activatable adhesive in at least one area corresponding to the end portion of the interior upper; placing the interior upper on the insole such that the end portion of the interior upper lies on the insole; sewing the end portion of the interior upper to the insole along the perimetral edge of the end portion of the interior upper; positioning the exterior upper such that the exterior upper envelops the interior upper; turning the end portion of the interior upper to the inside such that the end portion of the interior upper, together with the insole and the exterior upper, encloses a cavity; sewing the lower end of the exterior upper to an outer edge of the insole; placing the end portion of the interior upper flush against the insole; activating the adhesive on the layer of the insole and pressing the end portion of the interior upper against the insole so that a waterproof connection is formed between the end portion of the interior upper and the insole.

The use of an activatable adhesive enables the layer to be sewed to the insole initially, before the end portion of the interior upper is glued to the insole. Because the end portion of the interior upper has not yet been glued to the insole, it is thus possible to turn the lower portion of the interior upper to the inside, and to displace the interior upper from the danger zone of the needle penetrating through the exterior upper. By virtue of the end edge of the end portion of the interior upper, which has previously been sewed to the insole, it is possible, after completing the sewing of the exterior upper to the insole, to place the interior upper flush against the exterior upper, and the end portion of the interior upper flush against the insole, without creasing. The layer of activatable adhesive on the insole can then be activated, whereupon the waterproof connection between the insole and the end portion of the interior upper can be effected by the activated adhesive, preferably under pressure.

The sewing of the end portion of the interior upper to the insole along the perimetral edge of the end portion of the interior upper is usually performed directly along, or only a few millimetres away from, the perimetral edge of the end portion. Thus providing, for waterproof gluing of the end portion of the interior upper to the insole, a surface that is broad enough to efficiently prevent penetration of water. To simplify the sewing on of the end portion of the interior upper, it is useful to mark, on the insole, a contour along which the perimetral edge of the end portion of the interior upper is to be sewed on to the insole. The insole is preferably constructed so as to be somewhat recessed in the region on which the end portion of the interior upper is to be placed. This recess gives rise to a perimetral edge on the insole, on to which the perimetral edge of the end portion of the interior upper can be fitted before the end portion of the interior upper is sewed on. The perimetral edge of the insole also has the advantage that when the layer of activatable adhesive is applied on the insole, the region for this layer is specified so that the region for waterproof connection of the end portion of the interior upper to the insole is clearly defined. The recess has the additional advantage in that it can be made to such a depth that, after gluing of the end portion of the interior upper to the insole in the interior of the shoe, the end portion of the interior upper forms a continuous surface with the free part of the insole. Thus resulting, in many instances, an additional insole that can be dispensed with in the shoe structure of the invention, without any reduction in comfort for the wearer of the shoe.

It has proved particularly favourable, in the method of the invention, to apply a layer of an activatable adhesive to the end portion of the interior upper before placing the interior upper on the insole. In this way an activatable adhesive is provided on the insole as well as on the end portion of the interior upper, so that the water tightness required to be achieved by the gluing can be guaranteed in a particularly simple way.

It has also been found advantageous to provide, as the insole, a waterproofed insole. The waterproofing of the insole can be achieved in the simplest case through a waterproof layer applied to the surface of the insole facing the foot, the waterproof layer consisting of a waterproof polymer or a waterproof, water-vapour permeable functional layer. However, waterproofing of the insole can also be achieved if the insole itself consists of a waterproof material, either in its entirety or at least in the region corresponding to the end portion of the interior upper.

It has proved particularly favourable for the method of the invention to use an activatable adhesive that is thermally activatable for the layer on the insole and/or the layer on the end portion of the interior upper.

A shoe structure is usually heated in hot air after the sewing of the exterior upper to the insole and after insertion of a last, particularly when the exterior upper is of leather or a material similar to leather, a result of which the exterior upper adapts to the insole contour and to the form of the last. The heat required for this purpose is generally sufficient to bring the thermally activatable adhesive into the tacky state, following which the shoe along with the last can be placed in a press directly after the application of heat. The pressure exerted in the press can bring about the waterproof connection between the end portion of the interior upper and the insole.

The placing of the interior upper flush against the exterior upper and of the end portion of the interior upper flush against the insole can be done manually in the simplest case. Because the perimetral edge of the end portion of the interior upper is fixed to the insole via the seam, it has been found that the insertion of a last into the shoe suffices to position the interior upper against the exterior upper, and the end portion of the interior upper against the insole, without the formation of creases. The method of the invention is distinguished particularly by the insertion of the interior upper, the exterior upper and the insole into the shoe structure for positioning the end portion of the interior upper.

The invention, according to a second exemplary aspect, is a shoe structure including an exterior upper that is sewed at its lower end to an insole, and having an interior upper comprising a waterproof, water-vapour permeable functional layer and a lining, the interior upper having in the region of the sole, an end portion that is folded inwards, is connected in a waterproof manner to the insole and has a perimetral edge enclosing an opening, wherein the end portion of the interior upper is sewed to the insole along the perimetral edge. A shoe structure of this type is particularly simple to manufacture without the simple manufacturing method affecting in any way the water tightness of the waterproof, water-vapour permeable functional layer or the comfort of the wearer of the shoe of the invention by, e.g., the formation of creases in the lining upper.

The shoe structure of the invention is distinguished particularly by the fact that the insole has a recess along its perimeter on which the end portion of the interior upper is positioned, and that the recess of the insole is formed such that in the interior of the shoe structure the end portion of the interior upper forms a continuous surface with the insole.

BRIEF DESCRIPTION OF THE DRAWINGS

Various embodiments of the invention will be described with reference to the following figures, wherein.

DETAILED DESCRIPTION OF PREFERRED EMBODIMENTS

The method of the invention will now be explained in more detail with the help of FIGS. 1 to 4. The section of an interior upper shown in these figures is labelled 2. The interior upper comprises at least a lining facing the interior of the shoe structure and a waterproof, water-vapour permeable functional layer, which is usually connected to the lining. However, the interior upper 2 may contain further layers, which are usually textile fabrics. These layers are not shown in the figures. The section of the interior upper shown in FIG. 1 has at its lower end a layer 4 of activatable adhesive.

Figure 1:
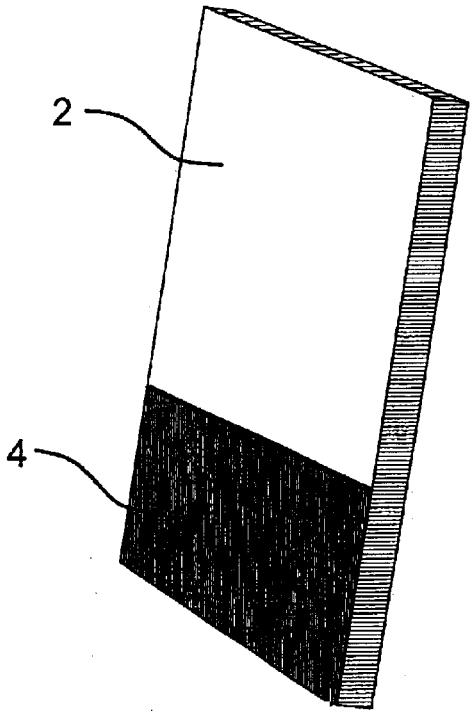
FIG. 1 is a section of an interior upper for the manufacturer of a shoe structure of the invention.
Figure 2:
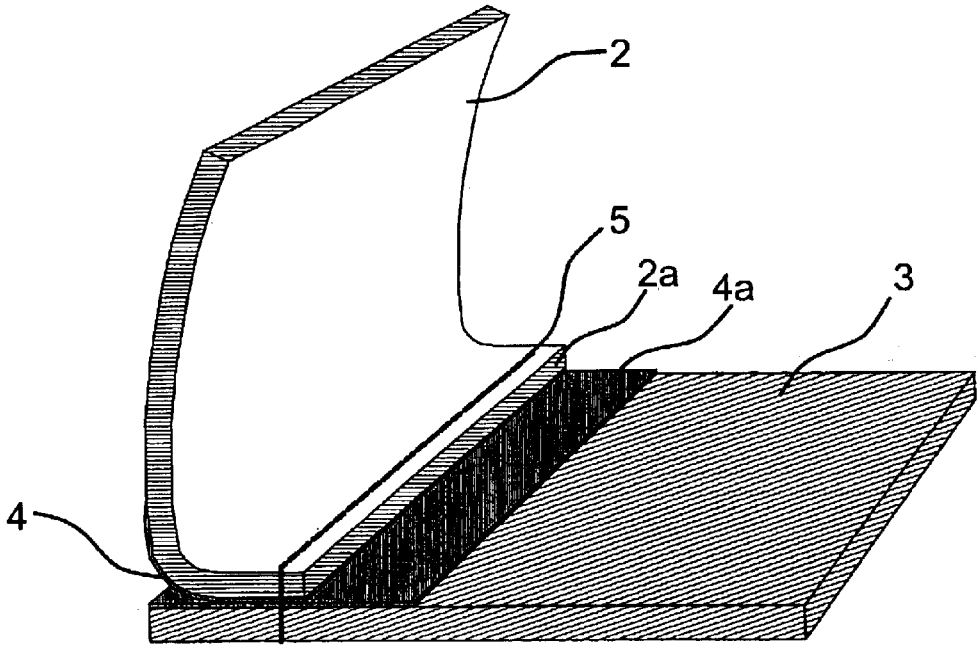
FIG. 2 is a section of a shoe structure of the invention after the production step in which the end portion of the interior upper is sewed along the perimetral edge to the insole.
Figure 3:
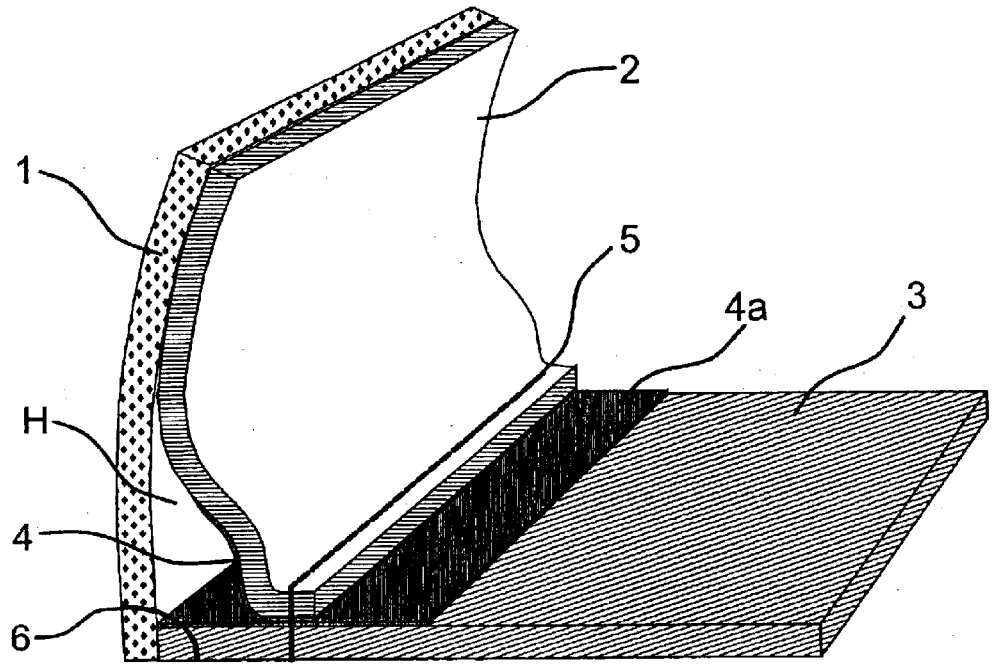
FIG. 3 is a section of a shoe structure of the invention in which the end portion of the interior upper has been turned to the inside and the exterior upper has been sewn to the insole.
Figure 4:
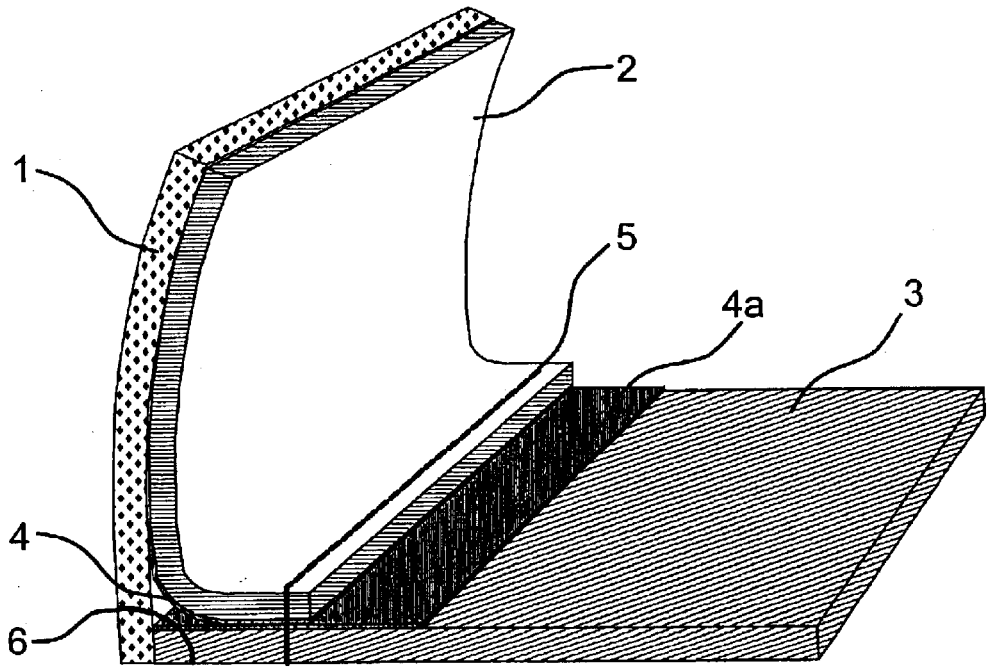
FIG. 4 is a section of a shoe structure of the invention in which the interior upper has been placed flush against the exterior upper and the end portion of the interior upper flush against the insole.
Figure 5:
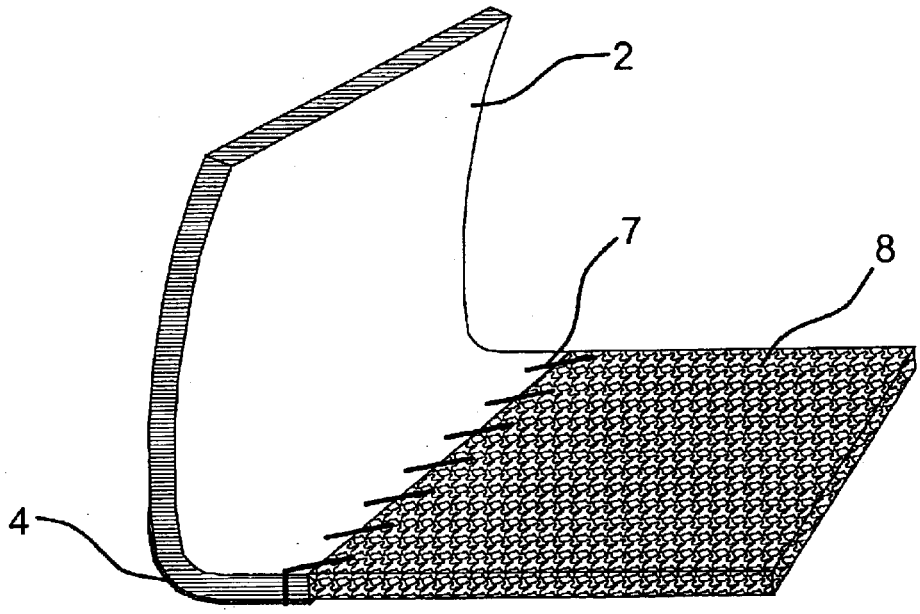
FIG. 5 is a section of an interior upper for the manufacturing of a shoe structure of the invention, in which the end portion of the interior upper is extended by a porous material.
Figure 6:
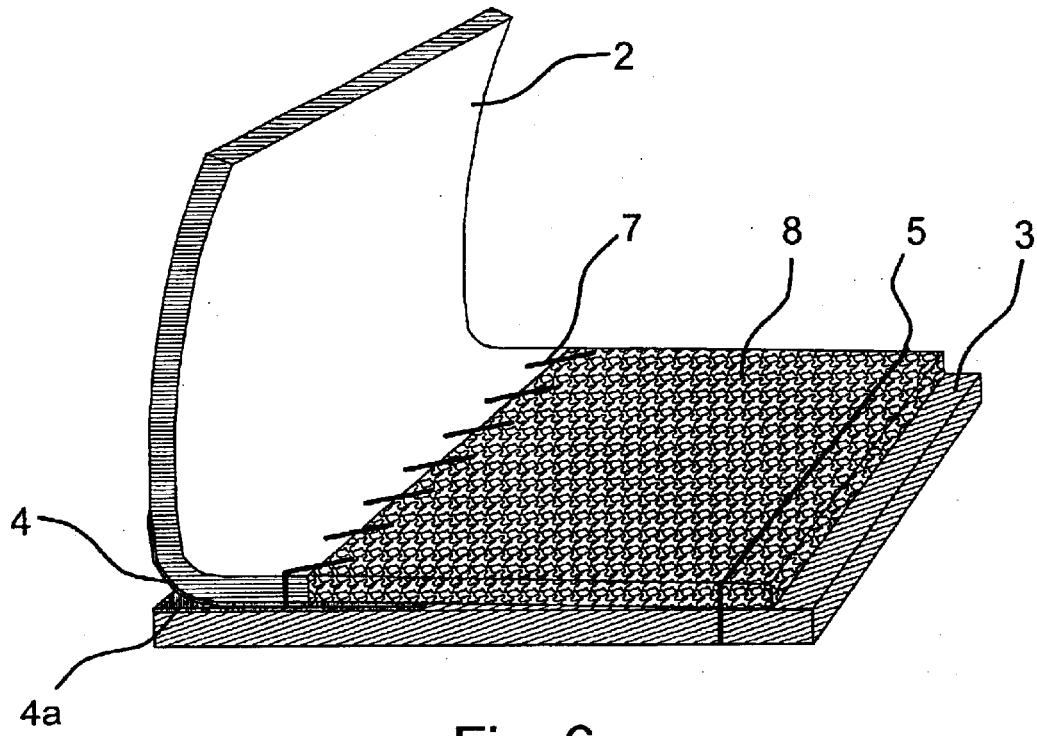
FIG. 6 is a section of a shoe structure of the invention in which the interior upper as in FIG. 5 is sewed along its perimetral edge to the insole.
Figure 7:
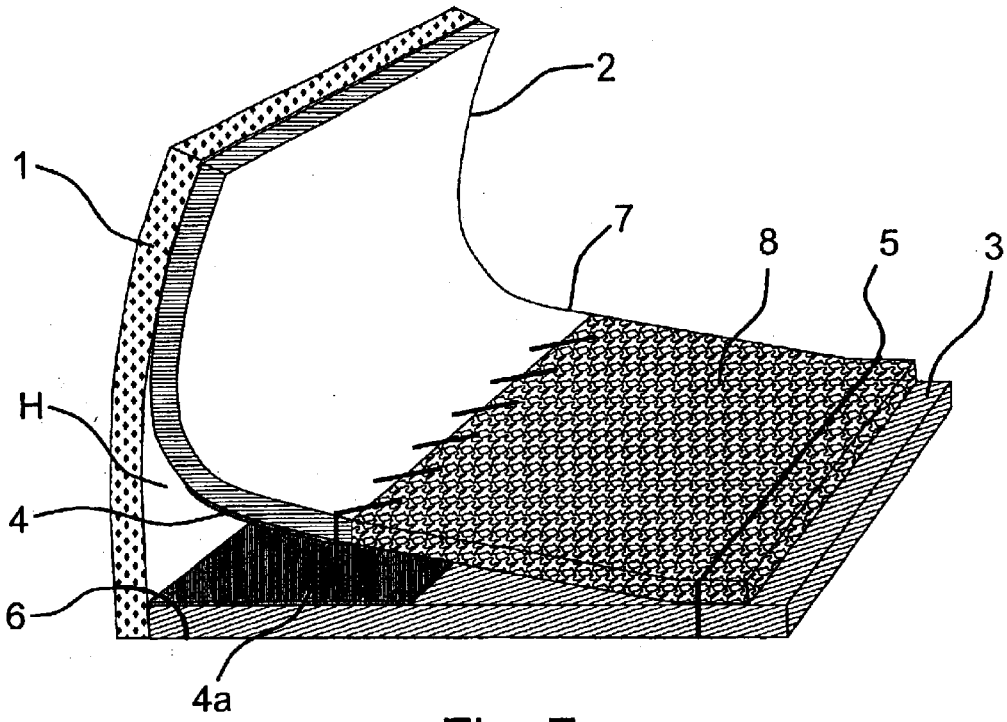
FIG. 7 is a section of a shoe structure of the invention as in FIG. 6, in which the end portion of the interior upper with its extension is turned to the inside.
Figure 8:
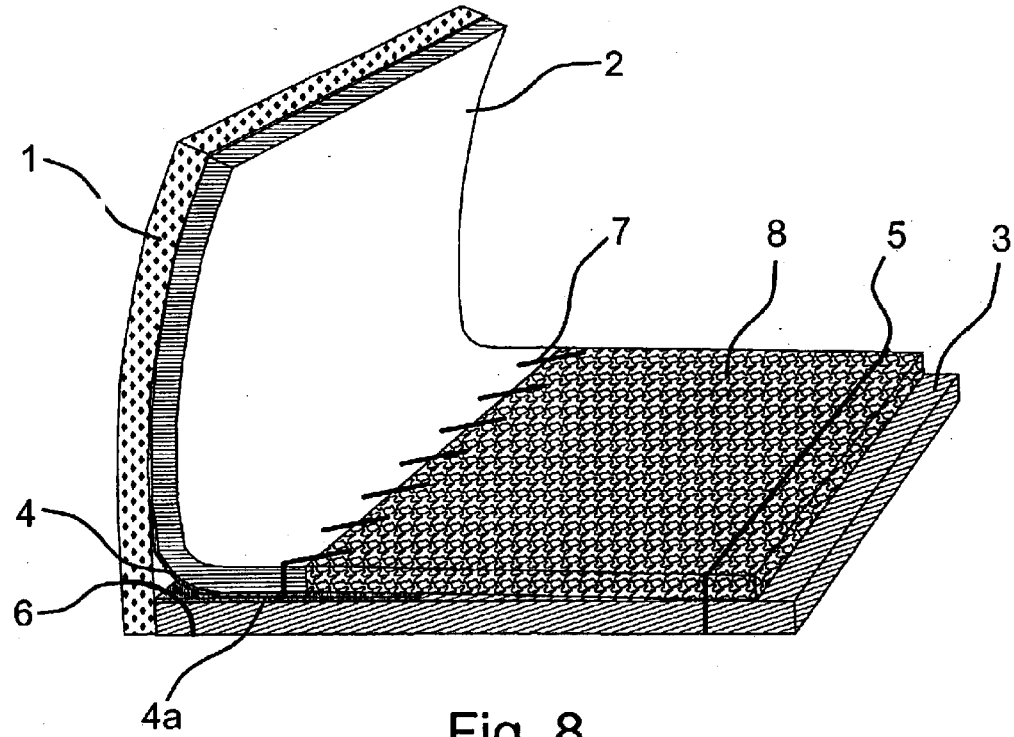
FIG. 8 is a section of a shoe structure of the invention as in FIGS. 6 and 7 where the interior upper has been placed flush against the exterior upper.

The interior upper 2 is placed with its end portion on an insole 3, which has a layer 4*a* of activatable adhesive, and is stitched to the insole 3 via seam 5 along the perimetral edge 2*a* (FIG. 2). The end portion of the interior upper 2 is then turned to the inside of the shoe structure such that the end portion of the interior upper 2, the insole 3 and the exterior upper 1 form a cavity H (FIG. 3). The exterior upper 1 is then stitched to the insole 3 via seam 6. The interior upper 2 is now positioned so as to lie flush against the exterior upper 1 and the insole 3, as shown in FIG. 4. The activatable adhesive of layers 4 and 4*a* is then activated and pressure applied to effect a waterproof connection between the end portion of the interior upper 2 and the insole 3.

FIGS. 5 to 8 show another possibility for implementing the method of the invention. In this embodiment the lower part of the end portion of the interior upper 2 includes an extension 8, which is connected to the actual upper material, e.g., via a seam 7. The sewing to the insole 3 in this example occurs via the extension 8. The extension 8 can serve, on the one hand, to allow seam 5 to be sewed in a position that is more conveniently accessible by the sewing machine necessary for the purpose. The extension 8 can also serve to increase the comfort of the shoe of the invention by using an elastic material in the extension 8, which the wearer of the shoe of the invention finds pleasant. In the context of the invention, the extension 8 can also be a structure in the form of an insole whose edge is connected to the perimetral edge of the interior upper 2 and which serves as an extension for the adjacent sides of the interior upper 2. With this type of extension, it suffices to sew the end portion of the interior upper 2 to the insole via a single seam running through the middle of the insole-type structure.

In the embodiment shown in FIGS. 5 to 8, parts having the same function as in the embodiment shown in FIGS. 1 to 4 are designated by the same reference numbers.

What is claimed is:

1. A method for manufacturing a shoe structure comprising an exterior upper sewn at a lower end of the exterior upper to an insole and an interior upper comprising a waterproof, water-vapour permeable functional layer and a lining, the interior upper having in the region of the insole, an inwardly folded end portion which is connected in a waterproof manner to the insole and has a perimetral edge enclosing an opening, comprising:

providing the exterior upper whose lower end is contoured towards the insole so as to correspond at least approximately to an outer contour of the insole;

providing the interior upper having at least a lining facing the inside of the shoe structure and a functional layer, the interior upper having towards the insole, the inwardly folded end portion that has the perimetral edge enclosing the opening;

providing the insole with a layer of an activatable adhesive in at least one area corresponding to the end portion of the interior upper;

placing the interior upper on the insole such that the end portion of the interior upper lies on the insole;

sewing the end portion of the interior upper to the insole along the perimetral edge of the end portion of the interior upper;

positioning the exterior upper such that the exterior upper envelops the interior upper;

turning the end portion of the interior upper to the inside such that the end portion of the interior upper, together with the insole and the exterior upper, encloses a cavity;

sewing the lower end of the exterior upper to an outer edge of the insole;

placing the end portion of the interior upper flush against the insole;

activating the adhesive on the layer of the insole; and pressing the end portion of the interior upper against the insole so that a waterproof connection is formed between the end portion of the interior upper and the insole.

2. The method according to claim 1, wherein the end portion of the interior upper is provided with a layer of an activatable adhesive before the interior upper is placed on the insole.

3. The method according to claim 1, wherein a waterproofed insole is provided.

4. The method according to claim 1, wherein a thermally activatable adhesive is used as the activatable adhesive.

5. The method according to claim 1, wherein a last is inserted into the shoe structure for positioning of the end portion of the interior upper.

6. The method according to claim 1, wherein the insole is marked with a contour representing where the perimetral edge of the end portion is to be sewn on to the insole.

7. The method according to claim 1, wherein the insole is recessed in a region in which the end portion of the interior upper is placed.

8. The method according to claim 7, wherein the insole is recessed such that after the end portion of the interior upper is placed on the insole, the end portion of the interior upper forms a continuous surface with the insole.

* * * * *